US005173580A

United States Patent [19]

Levin et al.

[11] Patent Number: 5,173,580

[45] Date of Patent: Dec. 22, 1992

[54] SUSCEPTOR WITH CONDUCTIVE BORDER FOR HEATING FOODS IN A MICROWAVE OVEN

[75] Inventors: Liza Levin, Plymouth; Peter S. Pesheck, Brooklyn Center, both of Minn.

[73] Assignee: The Pillsbury Company, Minneapolis, Minn.

[21] Appl. No.: 614,392

[22] Filed: Nov. 15, 1990

[51] Int. Cl.[5] ..... H05B 6/80; A23L 1/28

[52] U.S. Cl. ..... 219/10.55 E; 426/107; 426/113; 426/234; 426/243

[58] Field of Search ..... 219/10.55 F, 10.55 E; 426/107, 113, 126, 243, 234; 99/DIG. 14

[56] References Cited

U.S. PATENT DOCUMENTS

| | | | |
|---|---|---|---|
| 4,266,108 | 5/1981 | Anderson et al. | 219/10.55 E |
| 4,434,197 | 2/1984 | Petriello et al. | 219/10.55 E |
| 4,626,641 | 12/1986 | Brown | 219/10.55 E |
| 4,735,513 | 4/1988 | Watkins et al. | 219/10.55 E |
| 4,883,936 | 11/1989 | Maynard et al. | 219/10.55 F |
| 4,962,000 | 10/1990 | Emslander et al. | 219/10.55 E |

*Primary Examiner*—Bruce A. Reynolds
*Assistant Examiner*—Tuan Vinh To
*Attorney, Agent, or Firm*—Honigman Miller Schwartz and Cohn

[57] ABSTRACT

An apparatus to provide more uniform heating of a food product in a microwave oven is disclosed. The invention employs a susceptor in combination with a conductive sheet forming a border around the edge of the susceptor and having an opening in the center exposing the susceptor.

6 Claims, 1 Drawing Sheet

SUSCEPTOR WITH CONDUCTIVE BORDER FOR HEATING FOODS IN A MICROWAVE OVEN

CROSS-REFERENCE TO RELATED APPLICATIONS

This application contains subject matter related to application Ser. No. 404,200, filed Sep. 5, 1989, which is a continuation of application Ser. No. 119,381, filed Nov. 10, 1987, now U.S. Pat. No. 4,927,991, the entire disclosure of which is incorporated herein by reference. This application also discloses subject matter related to application Ser. No. 162,280, filed Feb. 29, 1988, now U.S. Pat. No. 4,972,059, the entire disclosure of which is incorporated herein by reference.

BACKGROUND OF THE INVENTION

Microwave cooking often offers advantages of speed and convenience in heating foods. However, the heating characteristics in a microwave oven for some food products is dramatically different from that experienced in a conventional oven. One problem with microwave cooking is that necessary temperatures for browning and crisping of the surface of food products typically are not achieved. Moreover, microwave cooking may leave the food surface soggy, which is oftentimes undesirable and detrimental to the texture and taste of the food. These are old problems in the art, and many attempts have been made to solve them.

In the past, attempts to solve some problems with microwave cooking have involved the use of susceptors which heat in response to microwave radiation. Typically, susceptors have been used which contain a thin film of aluminum deposited upon a polyester film substrate which is in turn bonded to paper. U.S. Pat. No. 4,641,005 discloses a thin film susceptor of this type. Typically, such thin film susceptors will deteriorate or break up during microwave heating. This deterioration and breakup of the susceptor can significantly change its performance characteristics, and for many food products, this is undesirable. Also, undesirable nonuniform heating effects across the surface area of the food product may result. Undesirable nonuniform heating as a function of time for a given area of the susceptor during the period of time that heating occurs may also result. For example, attempts to heat large pizzas with a thin film susceptor have generally resulted in overheating of the outside of the pizza, and underheating of the center of the pizza. The outside edge of the crust could be burned, while the center area came out soggy.

One solution to problems associated with microwave cooking is disclosed in Applicants' U.S. Pat. No. 4,927,991. A susceptor may be used in combination with a grid to achieve more uniform heating. The present invention provides an alternative to the use of a susceptor in combination with a grid for certain applications.

SUMMARY OF THE INVENTION

The present invention may provide substantially uniform heating during microwave cooking of a food product, such as a pizza. The present invention employs a susceptor in combination with a conductive margin or border. Preferably, a planar susceptor is used in combination with a planar conductive film margin or border in closely adjacent coplanar relationship with the susceptor.

DETAILED DESCRIPTION OF A PREFERRED EMBODIMENT

Figure 1:
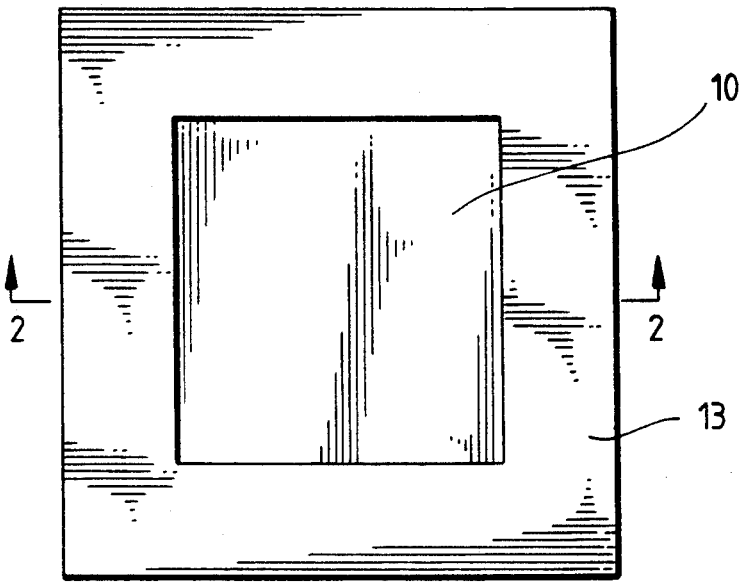
FIG. 1 shows a top view of a preferred embodiment employing a susceptor in combination with an aluminum film border.
Figure 2:
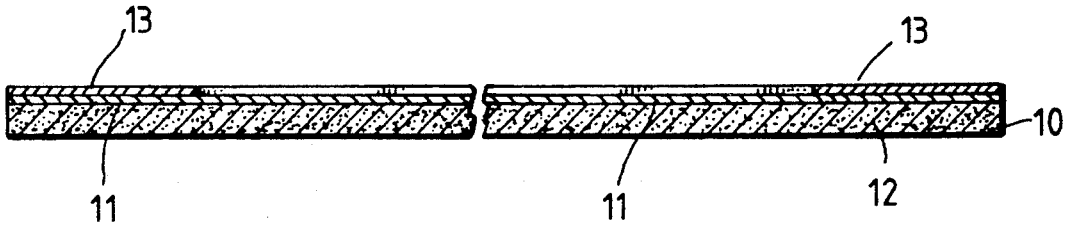
FIG. 2 is a cross-sectional side view of the susceptor in combination with an aluminum film border shown in FIG. 1.

FIGS. 1 and 2 depict a preferred embodiment of the present invention. The illustrated embodiment is particularly useful for microwave cooking of pizza.

The embodiment illustrated in FIG. 1 includes a susceptor 10. In the illustrated embodiment, the susceptor 10 has a thin film of metal deposited upon a sheet of polyester. Thin film deposition techniques, such as sputtering or vacuum deposition, may be used to deposit the metal film on the polyester substrate. The metal is preferably aluminum. The metallized polyester is adhesively bonded to a sheet of paper or paperboard. When the susceptor is exposed to microwave radiation, the susceptor will heat. This may be better seen in the cross-sectional view of FIG. 2. The thin film of metal deposited on a sheet of polyester forms a sheet of metallized polyester 11 which is bonded to paperboard 12. The sheet of metallized polyester conforms to the shape of the paperboard 12 and forms a flat susceptor means 10. Alternatively, the susceptor element may be any of the structures known in the art to heat in response to microwave radiation, and typically constructed in a generally planar shape.

Referring again to FIG. 1, the susceptor 10 is used in combination with a conductive border or margin 13. The conductive border 13 is preferably a flat planar thin sheet of aluminum associated in close coplanar relationship with the susceptor 10. The conductive border 13 is preferably adhesively bonded to the outermost portion of the surface of the susceptor 10, thereby forming a conductive margin or frame 13 for the heating surface 11 of the susceptor 10. Aluminum foil tape may be conveniently used for the conductive border 13.

The conductive border 13 is preferably highly reflective to microwave radiation. The conductive border 13 should be significantly more reflective to microwave radiation than the susceptor 10. The conductive border 13 preferably comprises a thin layer of aluminum foil having a thickness greater than about 5 microns. The conductive border 13 should preferably have a thickness greater than three skin depths for power penetration of the electromagnetic radiation into that material at the frequency of the microwave oven. The conductive border 13 forms a conductive surface surrounding a single transmissive aperture or area, and the conductive surface is in close proximity to the susceptor 10. Preferably, the material used for the conductive border 13 is a material that would not heat by itself in a microwave oven.

The conductive border 13 and the susceptor 10 are placed on the same side of a food item which is to be heated. Preferably, a food item such as a pizza may be effectively heated which is substantially the same size as the susceptor/conductive border combination illustrated in FIG. 1.

For a microwave oven having an operating frequency of 2.45 GHz, dimensions for the illustrated embodiment which have given useful results in practice are a square susceptor having a length and width which is six inches by six inches. The conductive margin in the illustrated embodiment has a width of about one inch. Thus, in this example, a four inch by four inch square area of the susceptor is left exposed, while an aluminum foil sheet covers an outer area extending inwardly from the edge of the susceptor a distance of one inch. While no particular size is especially preferred, this invention works well for relatively small susceptors, e.g., having a diameter less than or equal to about nine inches. For larger susceptors, a grid in combination with the susceptor is believed to perform better, and the difference in performance gradually becomes even greater as the susceptor is made larger.

It is believed that the conductive margin 13 around the peripheral area of the susceptor 10 reduces the tendency of the susceptor 10 to overheat the outer crust of the pizza or other food product. The conductive border 13 should be conductive enough to affect the boundary conditions of the electromagnetic field at the microwave frequency of the oven. The center transmissive area enhances heating of the center of the pizza or other food product relative to the outer edge. In the absence of the present invention, a food item such as a medium to large pizza cooked in a microwave oven on a conventional susceptor would often turn out with a burned outer crust and a soggy center. The present invention reduces the tendency of the outer crust to overheat and burn, and enhances the heating of the center to reduce its tendency for coming out soggy. More uniform heating results through use of the present invention. The effect of the conductive margin is to provide a more uniform temperature profile for areas removed from the conductive margin, and in particular the center of the area to be heated.

A round susceptor or a rectangular susceptor may also be used, in addition to other shapes. For a microwave oven having an operating frequency of 2.45 GHz, susceptors having a diameter between five inches and seven inches are preferred. A conductive margin width of about one inch is preferred. The susceptor 10 is preferably planar. The conductive margin 13 is also preferably planar. The susceptor 10 and the conductive margin are preferably adhesively bonded to each other.

The plane of the susceptor 10 and the plane of the conductive margin 13 may be offset a distance from each other in a direction perpendicular to the plane of the susceptor, but the spacing between them is preferably less than ⅜ inch, more preferably less than ¼ inch, even more preferably less than ⅛ inch, and especially preferably less than 1/16 inch.

Example 1

A test was performed comparing a susceptor having a conductive border or frame around it made in accordance with the present invention, with a susceptor used alone. The susceptors were used to heat pizza in a microwave oven. Pizzas were heated until the cheese on top of the pizza was completely melted. Heating times varied between four and eight minutes, depending on the oven power of the particular microwave oven used. The pizza was removed from the oven, inverted, and the temperature across the surface of the pizza crust was measured using an infrared camera. The infrared camera used in this and other examples described herein was an Agema Infrared Systems, Model Thermovision 870 infrared camera. A thermal image computer, Model TIC-8000 running CATS Version 4 software, was used to perform a statistical analysis of the temperature readings. Maximum and minimum values of the temperature were measured at the center and edge of the crust.

The round pizzas had a diameter of 8¼ inches. The susceptors were round and had a diameter of 9¼ inches. The conductive border had an inner diameter of 7¾ inches, and an outer diameter of 8¾ inches.

The results are summarized in Table I. The statistics appearing in the table represent measurements taken with six specimens.

TABLE I

| Variable | Label | N | Mean | Minimum Value | Maximum Value | Standard Deviation |
|---|---|---|---|---|---|---|
| | DEVICE = SUSCEPTOR WITH CONDUCTIVE BORDER | | | | | |
| TOV | Average Temperature, deg C. | 6 | 111.8 | 108.0 | 115.0 | 2.8 |
| STDOV | Temperature Std | 6 | 15.6 | 9.4 | 19.9 | 3.4 |
| DELTA | Edge-Center Temperature, deg C. | 6 | 2.0 | −18.0 | 18.2 | 14.2 |
| TCTR | Center Temperature, deg C. | 6 | 110.5 | 98.9 | 124.0 | 11.4 |
| STDCTR | Center Temperature Std | 6 | 11.3 | 5.7 | 16.8 | 4.6 |
| TEDG | Edge Temperature, deg C. | 6 | 112.5 | 106.0 | 117.1 | 3.7 |
| | DEVICE = SUSCEPTOR ALONE | | | | | |
| TOV | Average Temperature, deg C. | 6 | 116.7 | 109.0 | 123.0 | 6.0 |
| STDOV | Temperature Std | 6 | 17.8 | 10.1 | 22.8 | 5.1 |
| DELTA | Edge-Center Temperature, deg C. | 6 | 12.1 | −22.5 | 29.6 | 20.1 |
| TCTR | Center Temperature, deg C. | 6 | 108.6 | 90.0 | 138.0 | 18.2 |
| STDCTR | Center Temperature Std | 6 | 12.2 | 4.6 | 23.5 | 6.8 |
| TEDG | Edge Temperature, deg C. | 6 | 120.7 | 115.5 | 128.9 | 4.8 |

A statistical analysis performed using SAS computer software, available from the SAS Institute, in Cary, N.C., yielded a standard deviation of the various temperatures measured over the entire heated area, as a measure of temperature uniformity. Satisfactory results were achieved with the susceptor and conductive frame made in accordance with the present invention. The standard deviation of the temperature variations was 3.4 degrees C. The susceptor used alone had a standard deviation of 5.1 degrees C.

EXAMPLE 2

A susceptor with a conductive frame was tested in six different microwave ovens, and compared with a susceptor used alone, which was heated in the same six different ovens. Each type of heater was used to heat a pre-baked nine inch diameter pizza. The size of the susceptors and the conductive border were about the same as the Example 1. The pizza crust temperature was measured using an infrared camera. The standard deviation of the variation in pizza crust temperature, and the average center temperature minus the average edge temperature, were calculated to provide a measure of nonuniformity of heating.

The results of the standard deviation calculations are tabulated below in Table II.

TABLE II

| Microwave Oven | Standard Deviation, deg C. |
|---|---|
| DEVICE = SUSCEPTOR WITH CONDUCTIVE BORDER | |
| Emerson | 19.9 |
| Kenmore | 15.8 |
| KMC | 15.7 |
| Litton | 16.9 |
| Quasar | 15.7 |
| Sharp | 9.4 |
| DEVICE = SUSCEPTOR ALONE | |
| Emerson | 22.8 |
| Kenmore | 21.9 |
| KMC | 21.4 |
| Litton | 14.4 |
| Quasar | 16.0 |
| Sharp | 10.1 |

The average center temperature minus the average edge temperature for the ovens tested are tabulated below in Table III.

TABLE III

| Microwave Oven | Center-Edge Temperature, deg C. |
|---|---|
| DEVICE = SUSCEPTOR WITH CONDUCTIVE BORDER | |
| Emerson | 10.5 |
| Kenmore | 13.1 |
| KMC | 18.2 |
| Litton | −9.0 |
| Quasar | −18.0 |
| Sharp | −3.0 |
| DEVICE = SUSCEPTOR ALONE | |
| Emerson | 25.2 |
| Kenmore | 28.5 |
| KMC | 29.6 |
| Litton | 4.5 |
| Quasar | −22.5 |
| Sharp | 7.5 |

The pizza crust average overall temperature was also measured. The results are tabulated in Table IV.

TABLE IV

| Microwave Oven | Average Overall Temperature, deg C. |
|---|---|
| DEVICE = SUSCEPTOR WITH CONDUCTIVE BORDER | |
| Emerson | 110 |
| Kenmore | 108 |
| KMC | 111 |
| Litton | 115 |
| Quasar | 112 |
| Sharp | 115 |
| DEVICE = SUSCEPTOR ALONE | |
| Emerson | 110 |
| Kenmore | 109 |
| KMC | 119 |
| Litton | 122 |
| Quasar | 123 |
| Sharp | 117 |

The susceptor having a conductive frame constructed in accordance with the present invention provided overall temperature heating which, in most ovens, was comparable with that achieved with a susceptor alone. Temperature uniformity in most ovens was better than that of the susceptor alone.

ADVANTAGES OF THE INVENTION

The above disclosure demonstrates that the present invention can improve uniformity of microwave heating, and may be particularly advantageous when used to heat pizza in a microwave oven. A good average overall temperature may be achieved during heating. The present invention is economical, which can be of critical significance in achieving a commercially viable disposable food package.

The above disclosure has been directed to a preferred embodiment of the present invention. The invention may be embodied in a number of alternative embodiments other than that illustrated and described above. A person skilled in the art will be able to conceive of a number of modifications to the above-described embodiment after having the benefit of the above disclosure and having the benefit of the teachings herein. The full scope of the invention shall be determined by a proper interpretation of the claims, and shall not be unnecessarily limited to the specific embodiments described above.

What is claimed is:

1. An apparatus for heating food in a microwave oven, comprising:

a first sheet of material defining susceptor means for heating in response to microwave radiation;

a second sheet of material defining a conductive reflective border region surrounding a transmissive center area, the second sheet of material being closely adjacent to the susceptor means; and, the first sheet of material and the second sheet of material being located on a same side of a food item to be heated.

2. The apparatus according to claim 1, wherein:

the first sheet of material is planar.

3. The apparatus according to claim 2, wherein:

the second sheet of material is planar.

4. The apparatus according to claim 3, wherein:

the first sheet of material and the second sheet of material are substantially parallel to each other.

5. The apparatus according to claim 4, wherein:

the second sheet of material comprises a sheet of Aluminum foil adhesively bonded to the susceptor means.

6. The apparatus according to claim 5, wherein:

the susceptor means comprises a sheet of metallized polyester adhesively bonded to a sheet of paper.

* * * * *

UNITED STATES PATENT AND TRADEMARK OFFICE

CERTIFICATE OF CORRECTION

PATENT NO. : 5,173,580

DATED : December 22, 1992

INVENTOR(S) : Liza Levin, et al

It is certified that error appears in the above-indentified patent and that said Letters Patent is hereby corrected as shown below:

Column 3, line 66, "2/3 inch," should be -- 1/2 inch --.

Column 6, line 37 (line 8 of claim 1), "the susceptor" should be -- a susceptor --; line 39 (line 10 of claim 1), "a same side" should be -- the same side --.

Signed and Sealed this

Twenty-fourth Day of May, 1994

Bruce Lehman

*Attest:*

BRUCE LEHMAN

*Attesting Officer*

*Commissioner of Patents and Trademarks*